US007134433B2

(12) United States Patent
Sato

(10) Patent No.: US 7,134,433 B2
(45) Date of Patent: Nov. 14, 2006

(54) SNORKEL CLIP

(75) Inventor: Hiromasa Sato, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 419 days.

(21) Appl. No.: 10/685,521

(22) Filed: Oct. 16, 2003

(65) Prior Publication Data

US 2004/0079365 A1 Apr. 29, 2004

(30) Foreign Application Priority Data

Oct. 21, 2002 (JP) ..... 2002-306203

(51) Int. Cl.

| | |
|---|---|
| ***B62C 11/16*** | (2006.01) |
| ***B62C 11/02*** | (2006.01) |
| ***A62B 18/08*** | (2006.01) |
| ***A44B 1/04*** | (2006.01) |
| ***A41F 1/00*** | (2006.01) |
| ***B63C 11/02*** | (2006.01) |
| ***B63C 11/10*** | (2006.01) |

(52) U.S. Cl. ..... 128/201.11; 24/339; 24/341; 24/669; 128/201.27; 128/201.26; 405/186; 405/187

(58) Field of Classification Search ..... 128/201.11, 128/201.27, 201.28, 204.26, 206.29; 405/185, 405/186, 187; 441/55, 56, 57, 58; 24/339, 24/341

See application file for complete search history.

(56) References Cited

U.S. PATENT DOCUMENTS

| | | | | |
|---|---|---|---|---|
| 4,907,582 | A * | 3/1990 | Meyerrose | 128/201.11 |
| 5,199,422 | A * | 4/1993 | Rasocha | 128/201.11 |
| 5,265,591 | A * | 11/1993 | Ferguson | 128/201.11 |
| 5,351,098 | A * | 9/1994 | McDaniels et al. | 351/112 |
| 6,350,030 | B1 * | 2/2002 | Fujima | 351/143 |
| 6,352,075 | B1 * | 3/2002 | Wang | 128/201.11 |
| 6,363,929 | B1 * | 4/2002 | Winefordner et al. | 128/201.11 |
| 6,736,136 | B1 * | 5/2004 | Chen-Lieh | 128/201.11 |
| 2004/0003809 | A1 * | 1/2004 | Pan | 128/201.11 |

* cited by examiner

*Primary Examiner*—Henry Bennett
*Assistant Examiner*—Annette Dixon
(74) *Attorney, Agent, or Firm*—Clark & Brody

(57) ABSTRACT

Here is disclosed a snorkel clip comprising a first clip member attached to a strap of a face mask for swimming or diving and a second clip member to which a breathing conduit of the snorkel is attached. The first clip member has a guide enabling the second clip member coupled to the first clip member to be moved in a longitudinal direction of the strap. The first and second clip members are formed with stopper means adapted to retain the second clip member at a desired position in the guide.

6 Claims, 7 Drawing Sheets

SNORKEL CLIP

BACKGROUND OF THE INVENTION

This invention relates to a clip serving to retain a snorkel on a strap of a face mask for swimming or diving worn by a swimmier or a diver during swimming or diving.

It is well known to retain a snorkel on a strap of face masks for swimming or diving and thereby to stabilize a tilt of the snorkel relative to the strap so that the snorkel may be effectively used. For example, U.S. Pat. No. 4,907,582 discloses a swivel clip attachment adapted to attach a snorkel to a strap. This clip comprises a first part attached to a breathing conduit of the snorkel and a second part attached to the strap wherein the first part is rotatable relative to the second part. This clip enables the snorkel to be tilted together with the first part attached thereto at a desired angle with respect to the strap. In other words, the snorkel can be tilted at an angle desired for a swimmer or a diver and it is not likely that this angle might be unintentionally varied. However, once the snorkel has been attached to the strap excessively aside toward the front or the rear, it is sometimes impossible for the swimmer or diver to achieve the appropriate condition of the snorkel merely by adjusting the tilting angle of the snorkel with respect to the strap. In the case of the swivel click attachment disclosed in the above-cited U.S. Pat. No. 4,902,582, while the second member attached to the strap can be slidably moved relative to the strap in the longitudinal direction of the strap, this second member must be substantially fixed to the strap during actual use of the snorkel. This requirement makes it difficult to achieve a fine position-adjustment of the snorkel in the longitudinal direction of the strap using the second member.

SUMMARY OF THE INVENTION

It is an object of this invention to provide a snorkel clip facilitating a snorkel attached to a strap to be position-adjusted in a longitudinal direction of the strap.

According to this invention, there is provided a snorkel clip comprising a first clip member adapted to be attached to a strap of a face mask for swimming or diving and a second clip member to which a breathing conduit of the snorkel is attached.

The first clip member is configured so as to be coupled to the second clip member and has a guide adapted to move the second clip member coupled to the first clip member in a longitudinal direction of the strap and there are provided between the first and second clip members stopper means adapted to retain the second clip member coupled to the first clip member at a predetermined position within the guide.

This invention may be exploited in preferred embodiments as follow:

The guide includes a groove defined by a longitudinal direction, a transverse direction and a depth direction corresponding to a longitudinal direction, a transverse direction and a thickness direction of the strap, respectively, the width of the groove being relatively large in a plurality of given regions and relatively narrow in an intermediate region defined between each pair of the adjacent given regions, a width of the second clip member in its region destined to come into engagement with the groove being substantially equal to the width of the given regions and larger that of the intermediate regions so that the second clip member may cooperate with the groove to form the stopper means, and at least one of the second clip member and the first clip member being elastically deformable so that the region of the second clip member may be moved through the intermediate regions in the longitudinal direction of the strap.

The guide includes a dovetail groove extending in the longitudinal direction and the second clip member includes a dovetail tenon adapted to be slidably brought into engagement with the dovetail groove.

The stopper means include an elastic body elastically compressed between the first clip member and the second clip member.

The stopper means comprise a first locking part formed by the first clip member and undulating like saw tooth to define crests and troughs and a second locking part formed by the second clip member so as to be successively brought into detachable engagement with one of the troughs under elastic deformation.

The first clip member and the second clip member are separably coupled to each other.

DETAILED DESCRIPTION OF THE PREFERRED EMBODIMENTS

Details of the snorkel clip according to this invention will be more fully understood from the description given hereunder with reference to the accompanying drawings.

Figure 1:
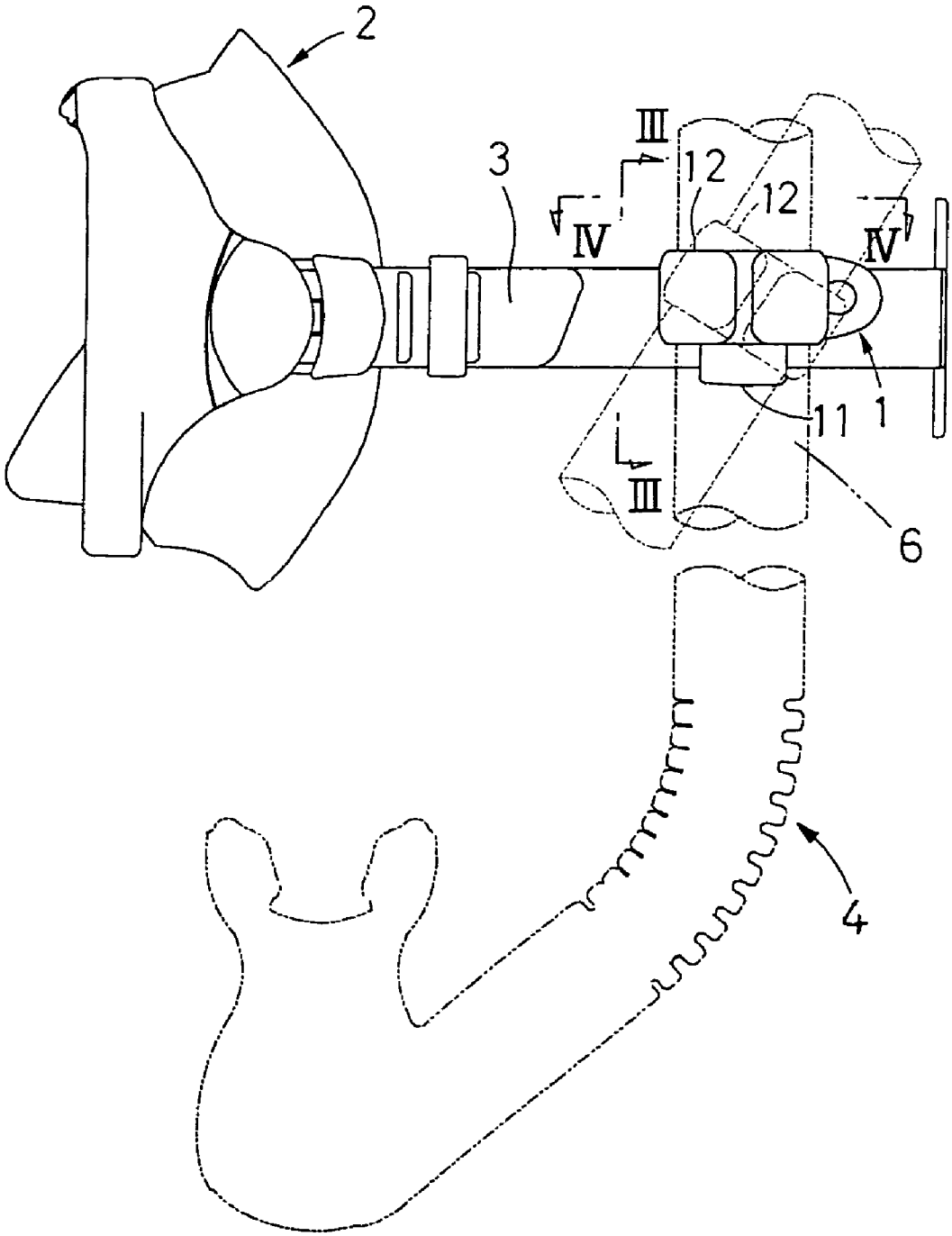
FIG. 1 is a front view showing a clip according to this invention as being used.

FIG. 1 is a view showing a snorkel clip 1 as being used. The clip 1 is attached to a strap 3 of a face mask 2 having a profile schematically illustrated and a breathing conduit 6 of a snorkel 4 indicated by an imaginary line is held by this clip 1. Referring to FIG. 1, the strap 3 extends in a horizontal direction and the snorkel 4 is supported by the clip 1 so that the snorkel 4 may extend vertically with respect to the strap 3 and be clockwise or counterclockwise tilted by the clip 1 as indicated by an imaginary line.

Figure 2:
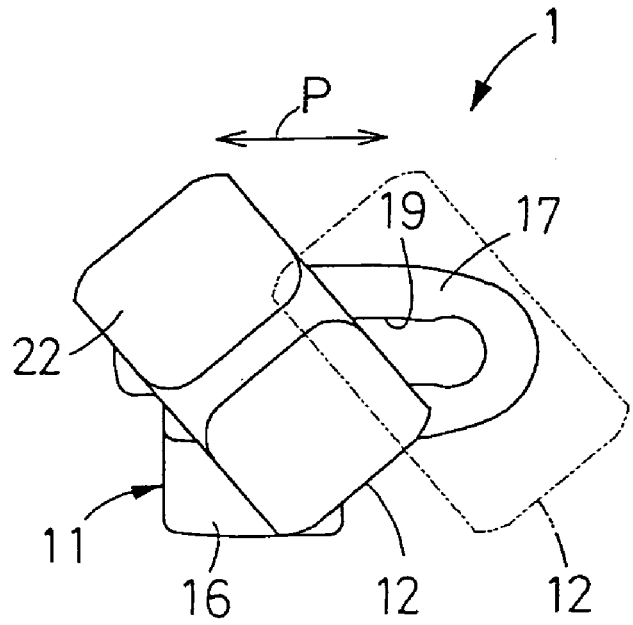
FIG. 2 also is a front view showing the clip as a second clip member is being rotated.
Figure 3:
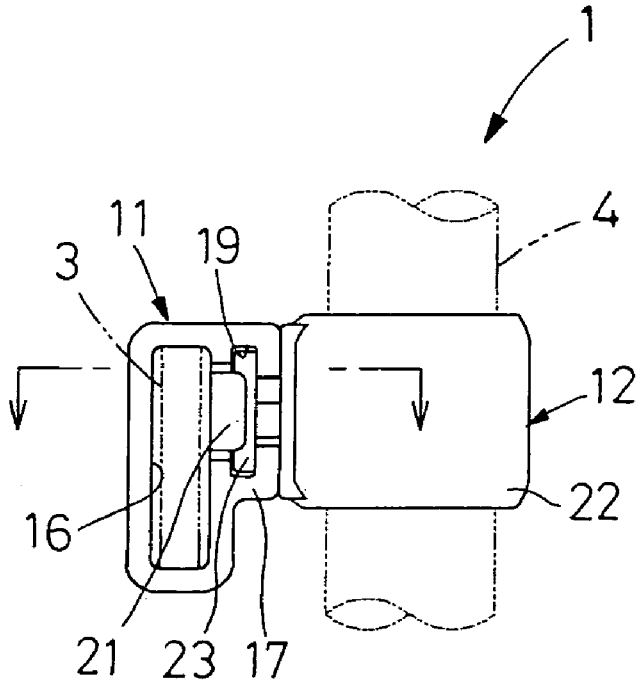
FIG. 3 is a side view of the clip.
Figure 4:
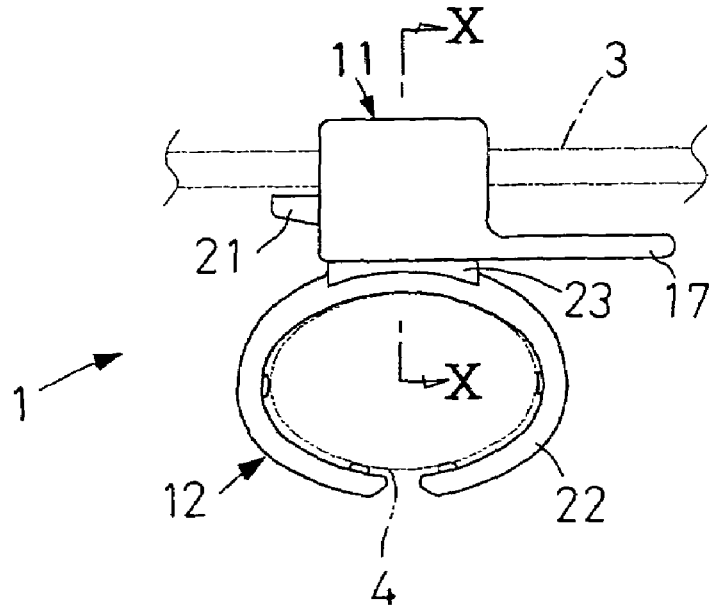
FIG. 4 is a top view of the clip.

FIG. 2 is a front view showing the clip 1 of FIG. 1, FIG. 3 is a side view of this clip 1 as seen in a direction indicated by arrows III—III, and FIG. 4 is a top view of this clip 1 as seen in a direction indicated by arrows IV—IV in which the strap 3 and the snorkel 4 are indicated by imaginary lines. In FIG. 2, the strap 3 and the snorkel 4 are not shown. The clip 1 comprises a first clip member 11 adapted to be attached to the strap 3 and a second clip member 12 to which the snorkel 4 is attached. The first clip member 11 has an opening 16 through which the strap 3 is inserted and a guide 17 serving as a pivot around which the second clip member 12 is rotatable and at the same time allowing the second clip member 12 to move in a longitudinal direction of the strap 3. The opening 16 has its width and height substantially corresponding to width and/or thickness of the strap 3 so that the opening 16 has its inner wall coming in contact with the strap 3 in the width and/or height direction(s) of the strap 3. Consequently, the first clip member 11 is attached to the strap 3 in such a manner that the first clip member 11 is slidable along the strap 3 intentionally but not unintentionally. In other words, the first clip member 11 is substantially fixed to the strap 3. The guide 17 has a dovetail groove 19 and a stopper 21.

The second clip member 12 has an annular grip 22 adapted to hold a breathing conduit 6 of the snorkel 4 and a dovetail tenon 23 adapted to be engaged with the dovetail groove 19 and slidably moved together with this dovetail groove 19 in the longitudinal direction of the strap 3. The grip 22 allows the breathing conduit 6 to slide in a height direction of the snorkel 4 and thereby to adjust a position in the height direction of the snorkel 4 relative to the strap 3. Such second clip member 12 is rotatable relative to the first clip member 11, for example, as illustrated in FIG. 1. The second clip member 12 can be slidably moved relative to the first clip member 11 in the longitudinal direction of the strap 3, i.e., in a direction indicated by a double-headed arrow P in FIG. 2 in which an imaginary line indicates the second clip member 12 after it has slidably moved.

Figure 5:
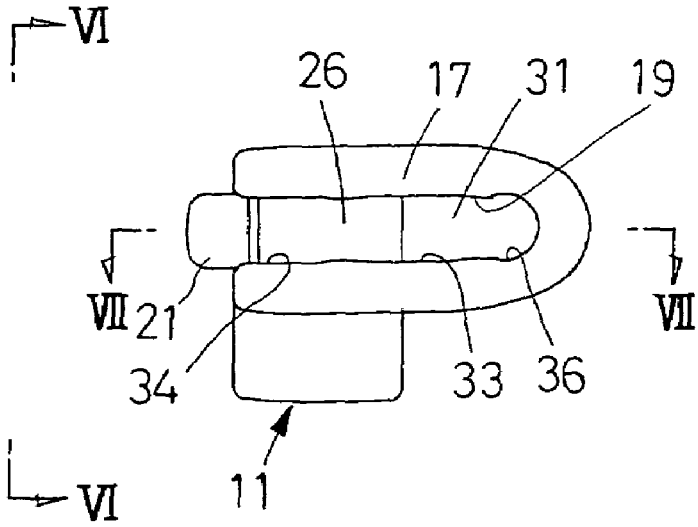
FIG. 5 is a front view of a first clip member.
Figure 6:
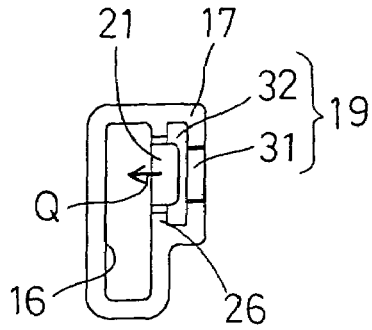
FIG. 6 is a side view of the first clip member.
Figure 7:
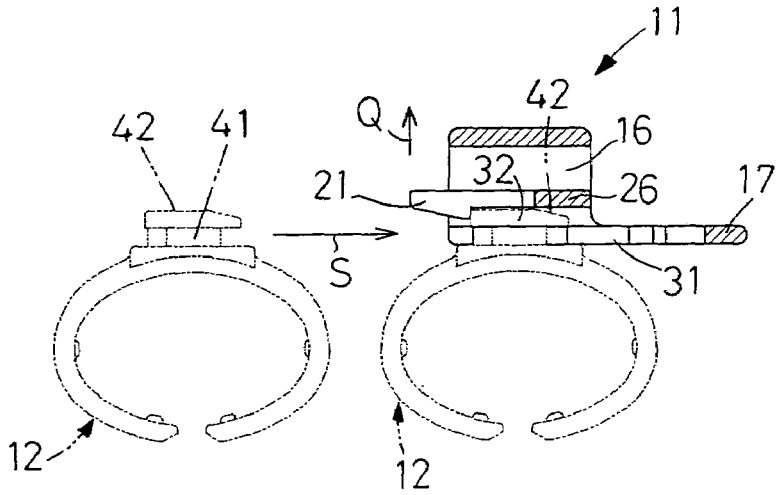
FIG. 7 is a sectional view of the first clip member in FIG. 5.

FIG. 5 is a front view of the first clip member 11, FIG. 6 is a side view of this first clip member 11 as seen in a direction of arrows VI—VI in this front view and FIG. 7 is a sectional view of this first clip member 11 taken along a line VII—VII in this front view. The opening 16 and the guide 17 of the first clip member 11 are partitioned by a wall 26. A part of the wall 26 defines the stopper 21 which is elastically deformable in a direction indicated by an arrow Q. The dovetail groove 19 of the guide 17 has a longitudinal direction, a transverse direction and a depth direction corresponding to the longitudinal direction, the transverse direction and the thickness direction of the strap 3. The dovetail groove 19 consists of a first groove 31 being relatively narrow as viewed in a vertical direction of FIG. 6 and a second groove 32 being relatively wide as viewed in this in direction. The first groove 31, in turn, consists of an intermediate region 33 being relatively narrow and left and right side regions 34, 36 being slightly wider than the intermediate region 33 as viewed in a transverse direction of FIG. 5. Referring to FIG. 5, the left side region 34 is open leftward and the right side region 36 is closed rightward.

Figure 8:
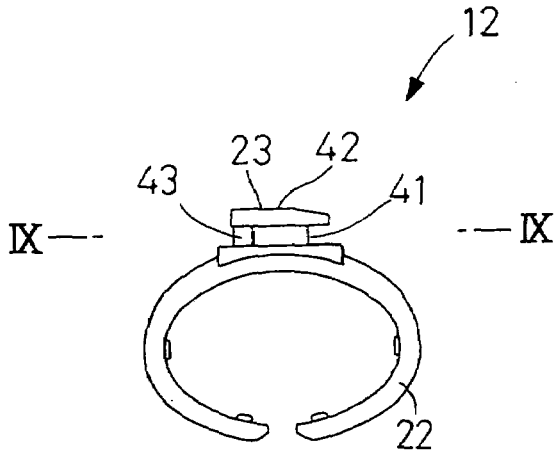
FIG. 8 is a top view of a second clip member.
Figure 9:
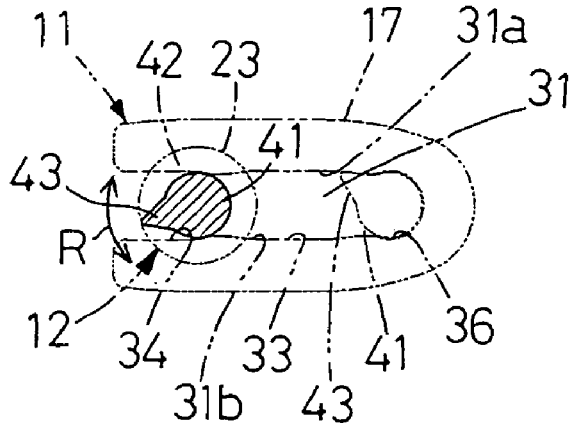
FIG. 9 is a sectional view taken along a line IX—IX in FIG. 8.

FIG. 8 is a top view of the second clip member 12 and FIG. 9 is a sectional view taken along a line IX—IX in this top view. In FIG. 9, outer shapes of the dovetail tenon 23 in the second clip member 12 and the guide 17 in the first clip member 11 are indicated by imaginary lines. The grip 22 of the second clip member 12 is elastically deformable to grip the snorkel 4. The dovetail tenon 23 comprises a first tenon 41 extending outward from the grip 22 and having a circular cross-section of a relatively small diameter, a second tenon 42 having a circular cross-section of a diameter larger than that of the first tenon 41 and a stop 43 radially extending outward from the first tenon 41. The second tenon 42 has a thickness gradually reduced from its left side region toward its right side region as seen in FIG. 8.

The first and second clip members 11, 12 respectively configured as has been described above are assembled together in a manner as illustrated in FIG. 7. The first and second tenons 41, 42 of the second clip member 12 are brought into engagement with the first and second groove 31, 32, respectively. Specifically, the stopper 21 is elastically deformed in the direction indicated by the arrow Q so as to open the left end of the second groove 32 as the second tenon 42 is advanced into the second groove 32, and thereby allows the second tenon 42 to be received by the second groove 32. Upon complete reception of the second tenon 42 by the second groove 32, the stopper 21 restores its initial position and substantially closes the left end of the second groove 32 so that the second tenon 42 can no more fall off from the left end of the second groove 32. The first tenon 41 advanced into the first groove 31 is received in the relatively wide left side region 34 of the first groove 31 as illustrated in FIG. 9. The first tenon 41 has a width (i.e., diameter) substantially equal to those of the first groove 31 in the left side region 34 and the right side region 36. The intermediate region 33 contiguous to this left end region 34 in the first groove 31 is narrower than the first tenon 41 and not move further into the intermediate region 33 unless the first tenon 41 is forcibly pushed toward the right and thereby elastically deforms the guide 17 so as to widen the intermediate region 33. In other words, the snorkel 4 is substantially fixed to the left side region 34 of the first groove 31 in the first clip member 11 together with the second clip member 12 so that the snorkel 4 might not easily slide rightward. However, it should be understood here that the first tenon 41 is rotatable in a direction indicated by a double-headed arrow R until the stopper 43 bears against a top wall 31*a* or a bottom wall 31*b* of the first groove 31. Such rotatable movement allows the snorkel 4 to be adjustably tilted relative to the strap 3. In the course of forcibly sliding the first tenon 41 rightward from its position in FIG. 9, the first tenon 41 can temporarily stay in the intermediate region 33 of the first groove 31 but ultimately steadies down in the right side region 36 and is substantially fixed again. The first tenon 41 in such state is indicated by an imaginary line and has its stop 43 bearing against the top wall 31*a*. In this way, the snorkel 4 is fixed in place again after it has moved in the longitudinal direction of the strap 3. Referring to FIG. 7, the stopper 21 may be deformed in the direction indicated by the arrow Q and the second tenon 42 may be slidably moved in the direction opposite to the arrow S to disassemble the second clip member 12 from the first dip member 11 in the clip 1.

Figure 10:
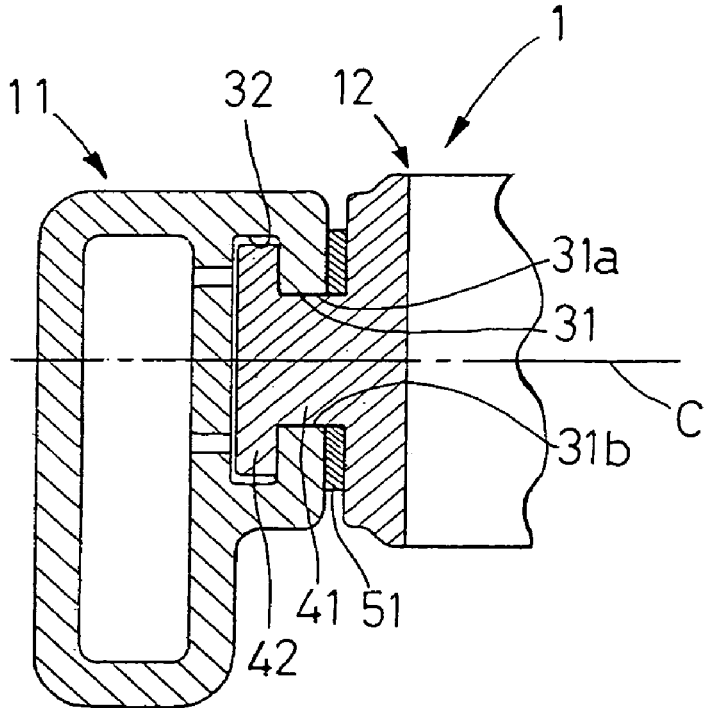
FIG. 10 is a sectional view showing one preferred embodiment of this invention.

FIG. 10 is a sectional view showing one preferred embodiment of this invention taken along a line X—X in FIG. 4. The clip 1 of FIG. 10 is distinguished from the clip 1 of FIG. 4 in that the first tenon 41 in the second clip member 12 carries thereon a ring-shaped slidable member 51 interposed between the first clip member 11 and the second clip member 12. This ring-shaped slidable member 51 illustrated in its sectional profile bears against these two clip members 11, 12 and resists against sliding of the second clip member 12 relative to the first clip member 11 in the longitudinal direction of the strap 3. Thickness as well as outer diameter and material of the slidable member 51 may be selected to adjust a strength at which the member 51 bears against the first and second clip members 11, 12 so that the second clip member 12 can be slidably moved relative to the first clip member 11 to a desired position and substantially fixed at this desired position. The strength at which the slidable member 51 bears against these two clip members 11, 12 is preferably adjusted so that the first clip member 11 can not slidably move relative to the strap 3 while the second clip member 12 is slidably moving. This slidable member 51 can be used with the clip 1. of FIG. 1 and may be configure also so as to bear against the top wall 31*a* as well as the bottom wall 31*b* of the first clip member 11. A line C in FIG.

10 corresponds to center lines of the first and second tenons 41, 42. The slidable member 51 preferably comprises an elastic body made of synthetic rubber or the like.

Figure 11:
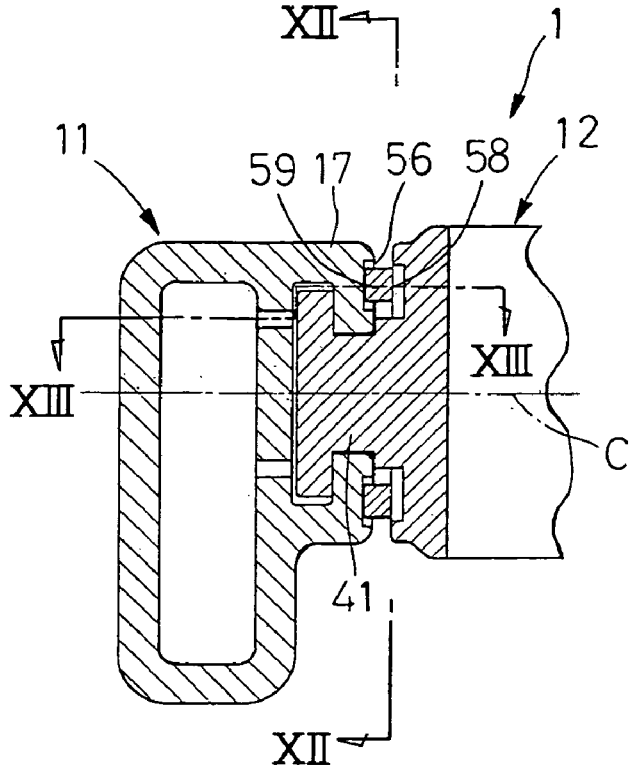
FIG. 11 is a view similar to FIG. 10 showing another preferred embodiment of this invention.
Figure 12:
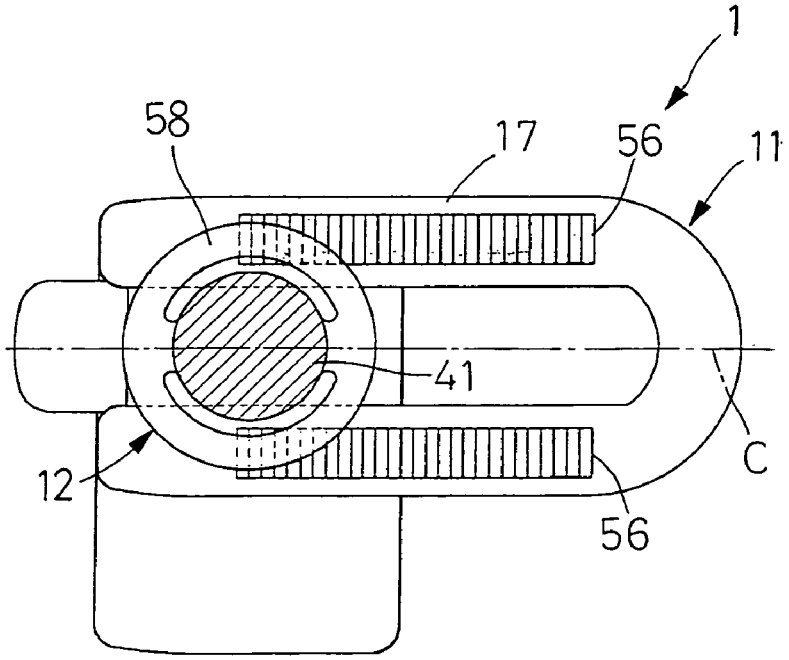
FIG. 12 is a sectional view taken along a line XII—XII in FIG. 11.
Figure 13:
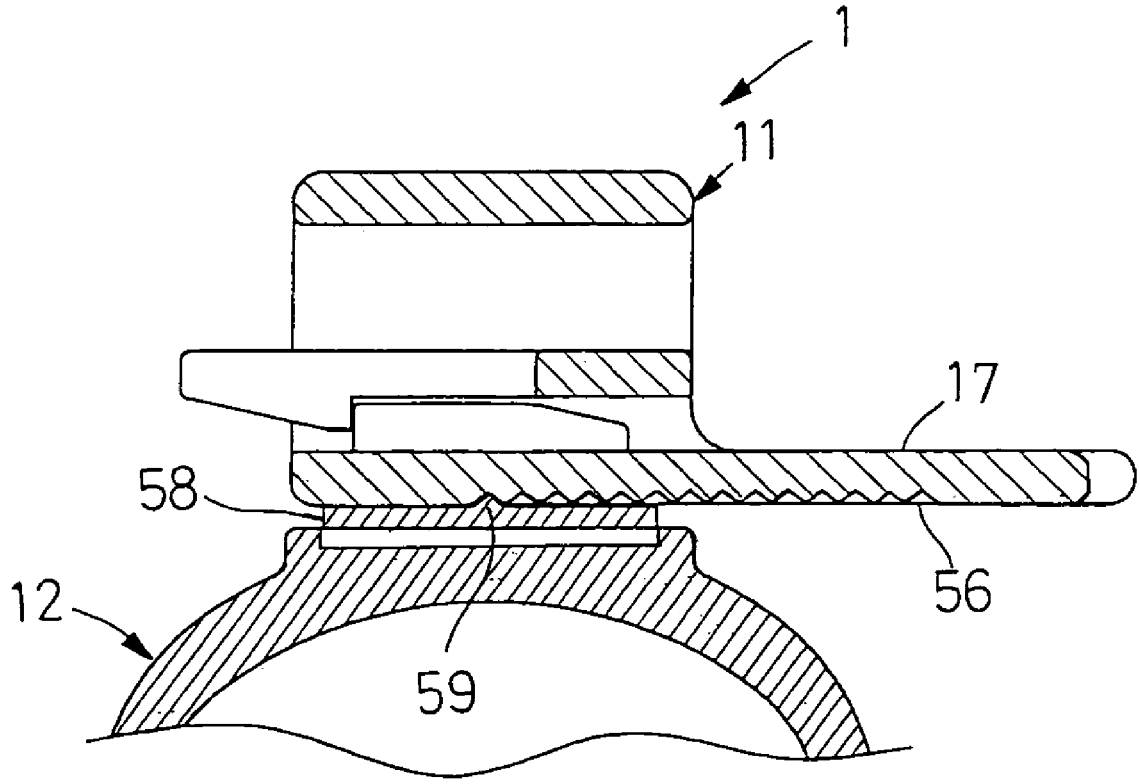
FIG. 13 is a sectional view taken along a line XIII—XIII in FIG. 11.

FIGS. 11, 12 and 13 show still another embodiment of this embodiment, of which FIG. 11 is a sectional view similar to FIG. 10, FIG. 12 is a sectional view taken along a line XII—XII in FIG. 11 and FIG. 13 is a sectional view taken along a line XIII—XIII in FIG. 11. The guide 17 of the first clip member 11 in this clip 1 is formed with a pair of indented zones 56 each extending in the longitudinal direction of the strap 3 (not shown) and having crests and troughs. The first tenon 41 in the second clip member 12 is formed with a substantially ring-shaped spring 58 which is, in turn, formed with a dent 59 adapted to be engaged with each pair of troughs of the indented zones 56 aligned side by side. Movement of the second clip member 12 relative to the first clip member 11 in the longitudinal direction of the strap 3 (not shown) elastically deforms the spring 58 and causes the dent 59 of the spring 58 to be successively engaged with each pair of the troughs of the indented zones 56 aligned side by side. Engagement of the dent 59 with these troughs causes the snorkel 4 to be substantially fixed to the strap 3. The ring-shaped spring 58 may be form intermittently along the circumference with a plurality of the dents 59 to make the second clip member 12 rotatable with respect to the first clip member 11. The line C in FIGS. 11 and 12 also corresponds to the center lines of the first and second tenons 41, 42.

The snorkel clip according to this invention is primarily characterized in that the second clip member to which the snorkel is attached is coupled to the first clip member attached to the strap in such a manner that the second clip member may be slidably moved relative to the first clip member in the longitudinal direction of the strap. This unique arrangement facilitates the snorkel to be fixed at a desired position in the longitudinal direction of the strap.

What is claimed is:

1. A snorkel clip comprising a first clip member adapted to be attached to a strap of a face mask for swimming or diving and a second clip member to which a breathing conduit of a snorkel is attached, said snorkel clip further comprising:

said first clip member being configured so as to be coupled to said second clip member and having a guide adapted to receive and slidably move said second clip member in a longitudinal direction of said strap, wherein said guide has a longitudinal direction in parallel with said longitudinal direction of said strap and is provided in said longitudinal direction with a couple of opposite end regions comprising one blind end region to stop the movement of said second clip member and the other openable end region to receive said second clip member which openable end region is closed by an elastically deformable stopper means provide in said first clip member to prevent said second clip member received in said guide from falling off from said openable end region.

2. The snorkel clip according to claim 1, wherein said guide is a dovetail groove and a width of said dovetail groove is relatively large in said opposite end regions and relatively narrow in an intermediate region defined between said opposite end regions, a width of a tenon of said second clip member to be slidably engaged with said dovetail groove being substantially equal to said width in said opposite end regions and larger than that in said intermediate region so that said second clip member may stay temporarily in said intermediate region.

3. The snorkel clip according to claim 1, wherein said first clip member has a first locking part and undulating like saw tooth to define crests and troughs and said second clip member has a second locking part to be successively brought into detachable engagement with one of said troughs under elastic deformation.

4. The snorkel clip according to claim 1, wherein said first clip member and said second clip member are separably coupled to each other.

5. A snorkel clip comprising a first clip member adapted to be attached to a strap of a face mask for swimming or diving and a second clip member to which a breathing conduit of a snorkel is attached, said snorkel clip further comprising:

said first clip member being configured so as to be coupled to said second clip member and having a guide adapted to move said second clip member in a longitudinal direction of said strap and there are provided between said first and second clip members stopper means adapted to retain said second clip member at a predetermined position within said guide, wherein said first clip member and said second clip member have a rotation angle limiting means adapted to limit an angular range within which said second clip member can rotate relative to said first clip member.

6. A snorkel clip comprising a first clip member adapted to be attached to a strap of a face mask for swimming or diving and a second clip member to which a breathing conduit of a snorkel is attached, said snorkel clip further comprising:

said first clip member being configured so as to be coupled to said second clip member and having a guide adapted to move said second clip member in a longitudinal direction of said strap and there are provided between said first and second clip members a stopper means adapted to retain said second clip member at a predetermined position within said guide, wherein said stopper means comprise a first locking part and undulating like saw tooth to define crests and troughs and a second locking part formed by said second clip member so as to be successively brought into detachable engagement with one of said troughs under elastic deformation.

* * * * *